United States Patent [19]

Endo et al.

[11] Patent Number: 4,505,217

[45] Date of Patent: Mar. 19, 1985

[54] RIGID MARINE SAIL

[75] Inventors: Yoichi Endo, Yokohama; Kazuo Nakanishi, Tokyo; Hideki Namura; Terukazu Doi, both of Yokohama; Katsunori Kusumoto, Yokosuka; Kazuyuki Shimizu, Fujisawa; Kazuhiko Yoshimi, Tokyo; Shigeru Nagai; Shoichi Sato, both of Yokohama, all of Japan

[73] Assignee: Nippon Kokan Kabushiki Kaisha, Tokyo, Japan

[21] Appl. No.: 489,700

[22] Filed: Apr. 29, 1983

[30] Foreign Application Priority Data

May 14, 1982 [JP] Japan ..... 57-80207
May 10, 1983 [KR] Rep. of Korea ..... 83-1990

[51] Int. Cl.[3] ..... B63H 9/06

[52] U.S. Cl. ..... 114/103; 114/39; 74/106; 74/520

[58] Field of Search ..... 114/39, 102, 103; 244/110 B, 113, 217; 74/106, 520

[56] References Cited

U.S. PATENT DOCUMENTS 3,024,605 3/1962 Nash ..... 74/106
3,035,411 5/1962 Porowski ..... 74/106
3,654,811 4/1972 Peterson ..... 74/520

FOREIGN PATENT DOCUMENTS 0064107 11/1982 European Pat. Off. .

OTHER PUBLICATIONS

European Patent Application; 1/27/1982, Akira, SN 0044724.

European Patent Application; 11/10/1982, Yoshimi, SN 0064107.

*Primary Examiner*—Trygve M. Blix
*Assistant Examiner*—Edwin L. Swinehart
*Attorney, Agent, or Firm*—Frishauf, Holtz, Goodman & Woodward

[57] ABSTRACT

A rigid marine sail comprises a vertical mast secured onto a deck of a ship; at least one pivot shaft provided substantially in parallel with the mast; a left sail portion and a right sail portion pivotally secured respectively to the left side and the right side of the mast in parallel therewith through the at least one pivot shaft; and at least one drive mechanism for symmetrically pivoting the left sail portion and the right sail portion relative to the mast around the pivot shaft between a deployed position and a folded position. Each of the drive mechanisms include a set of a cylinder and a piston rod secured horizontally to the mast; a pair of L-shaped first levers, each of the first levers horizontally engaging at an end thereof with an end of the piston rod, the pair of first levers being bilaterally arranged symmetrically relative to a vertical plane which passes through the vertical axis of the mast and is parallel to the longitudinal direction of the ship, the pair of first levers being symmetrically pivotable around respective fulcrums thereof; and a pair of second levers, each of the second levers horizontally engaging at an end thereof with the other end of each of the pair of first levers, and the pair of second levers engaging at the other ends thereof respectively with the left sail portion and the right sail portion.

6 Claims, 13 Drawing Figures

RIGID MARINE SAIL

FIELD OF THE INVENTION

The present invention relates to a rigid marine sail which permits, in a rigid marine sail comprising a left and a right sail portions, which is secured onto a deck of a ship for the effective utilization of wind force for the navigation of the ship, minimization of the area between the front end faces of the left and the right sail portions when these sail portions are pivoted to the folded position thereof to reduce the air resistance suffered from by said area between said front end faces, thereby improving the stability when sailing while pivoting the left and the right sail portions to the folded position thereof.

BACKGROUND OF THE INVENTION

Provision of a rigid sail onto the deck of an engine-driven ship has recently been proposed to effectively utilize wind force for the navigation of the ship from the point of view of energy saving, and some ships provided with rigid sails are practically in use.

One of the industrialized rigid marine sails is shown in FIGS. 1 to 4 (hereinafter referred to as the "prior art 1").

The above-mentioned prior art 1 is described below with reference to the drawings. In FIGS. 1 to 4, 1' is a mast vertically secured onto a deck 2' of a ship in such a manner that the lower end portion of the mast 1' is inserted into a mast support 3' fixed onto the deck 2', and the front face of the mast 1' forming part of the sail surface; 4' is a mast rotation mechanism for rotating the mast 1' around the vertical axis thereof, the mast rotation mechanism 4' comprising a gear 5' horizontally fixed to the lower end portion of the mast 1' and a motor 6' secured onto a side of the mast support 3' for rotating the gear 5'; 7' are two pivot shafts one each provided on the left and the right sides of the mast 1' substantially in parallel with the mast 1'; 8'A and 8'B are a left sail portion and a right sail portion which are pivotally secured respectively to the left and the right sides of the mast 1' substantially in parallel therewith through the respective pivot shafts 7'; 9' is a drive mechanism for symmetrically pivoting the left and the right sail portions 8'A and 8'B relative to the mast 1' around the respective pivot shafts 7' between the deployed position and the folded position, the drive mechanism 9' comprising a movable rod 11 secured to the mast 1' through a plurality of guide members 10 in parallel with the mast 1', vertically moving up and down, a lifting means 12 which comprises a hydraulic cylinder and other parts for vertically moving up and down the movable rod 11, and plural pairs of vertically spaced connecting rods 13 provided at portions of the left and the right sail portions 8'A and 8'B near the respective ends on the sides facing the pivot shafts 7'; ends of the plural pairs of connecting rods 13 being connected respectively to the left and the right sail portions 8'A and 8'B through respective swivel bearings 14A, and the other ends of the plural pairs of connecting rods 13 being connected respectively to the movable rod 11 through respective another swivel bearings 14B.

Now, operation of the rigid marine sail of the above-mentioned prior art 1 is described. To pivot the left sail portion 8'A and the right sail portion 8'B from the deployed position shown in FIGS. 1 and 2 to the folded position shown in FIGS. 3 and 4, the lifting means 12 is actuated to lower the movable rod 11, whereby the other ends of the plural pairs of connecting rods 13 are lowered down until the plural pairs of connecting rods 13 become substantially vertical. Thus, the left and the right sail portions 8'A and 8'B are pivoted to the folded position symmetrically relative to the mast 1' around the pivot shafts 7'. To pivot the left and the right sail portions 8'A and 8'B from the folded position to the deployed position, on the other hand, the lifting means 12 is actuated to raise the movable rod 11, whereby the other ends of the plural pairs of connecting rods 13 are raised up until the connecting rods 13 become substantially horizontal. Thus, the left and the right sail portions 8'A and 8'B are pivoted to the deployed position symmetrically relative to the mast 1' around the pivot shafts 7'.

The above-mentioned prior art 1 however involves the problems as described below. As described above, the left sail portion 8'A and the right sail portion 8'B are pivoted by the other ends of the plural pairs of connecting rods 13 vertically lowered down by means of the movable rod 11. The only force contributing to the pivoting motion of the left and the right sail portions 8'A and 8'B is the force acting horizontally, i.e., in a direction perpendicular to the pivot shafts 7' of the left and the right sail portions 8'A and 8'B from among the forces transferred from the movable rod 11 through the plural pairs of connecting rods 13 to the left and the right sail portions 8'A and 8'B. This horizontal force F is reduced to $F_o$, $F_1$ and then $F_2$ according as the left and the right sail portions 8'A and 8'B approach the folded position, as shown in FIG. 5. In contrast, the vertical force F' transferred through the plural pairs of connecting rods 13 to the left and the right sail portions 8'A and 8'B becomes larger to $F'_1$ and then $F'_2$ according as the left and the right sail portions 8'A and 8'B approach the folded position. At the moment when the left and the right sail portions 8'A and 8'B reach the folded position, therefore, an excessive vertical force F' acts on the left and the right sail portions 8'A and 8'B, and as a result, the left and the right sail portions 8'A and 8'B may be damaged.

A conceivable method for solving this problem is to increase the mechanical strength of the left and the right sail portions 8'A and 8'B. This however leads to a larger ship weight and higher shipbuilding costs. Another conceivable solution is, as shown in FIG. 6, to secure the left and the right sail portions 8'A and 8'B to the mast 1' with a longer distance L between the pivot shafts 7' and thus to increase the ratio of the vertical force F' to the horizontal force F transferred to the left and the right sail portions 8'A and 8'B. More specifically, in the case shown in FIG. 5, the ratio $F'_2/F_2$ of the vertical force $F'_2$ to the horizontal force $F_2$ at the moment when the left and the right sail portions 8'A and 8'B reach the folded position is about 4.5, whereas, in the case shown in FIG. 6, the ratio $F'_2/F_2$ is about 2.5. If the left and the right sail portions 8'A and 8'B are secured to the mast 1' with a longer distance L between the pivot shafts 7', therefore, an excessive vertical force F' does not act on the left and the right sail portions 8'A and 8'B even when the left and the right sail portions 8'A and 8'B reach the folded position, thus permitting prevention of damage to the left and the right sail portions 8'A and 8'B. However, when the left and the right sail portions 8'A and 8'B are thus secured to the mast 1' with a longer distance L between the pivot shafts 7', the left and the right sail portions 8'A and 8'B would have an increased area between the end faces thereof on the side of the pivot shafts 7' (hereinafter referred to as the "front end area") when the left and the right sail portions 8'A and 8'B reach the folded position, resulting in an increased air resistance acting onto the front end area when the left and the right sail portions 8'A and 8'B reach the folded position, thus impairing stable navigation of the ship. This inconvenience is particularly serious when the ship runs against a head wind.

Our experiment shows that, when the left and the right sail portions 8'A and 8'B are pivoted to the deployed position with the use of the above-mentioned drive mechanism 9', the ratio of the distance between the pivot shafts 7' to the overall width of the sail cannot be reduced to below about 18% in view of the above-mentioned ratio F'/F of the vertical force F' to the horizontal force F.

Now, another prior art (hereinafter referred to as the "prior art 2") disclosed in European Patent Provisional Publication No. EP 0 064 107 A1 is described below. FIG. 7 is a plan view illustrating a rigid marine sail of the prior art 2 in the deployed position. As shown in FIG. 7, a pivot shaft 7' is secured to a vertical mast 1' in front thereof with a space from the mast 1' in parallel with the mast 1' through plural pairs of fittings 15, and a left sail portion 8'A and a right sail portion 8'B pivotally engage at respective ends thereof with the pivot shafts 7' through plural pairs of blackets 16. In front of the pivot shaft 7', a semi-cylindrical shrouding plate 18 is secured to the pivot shaft 7' in parallel with the pivot shaft 7' through a plurality of fixing rods 17. Notches (not shown) are formed on the shrouding plate 18 for access of the plural pairs of blackets 16. The shrouding plate 18 covers the front end area of the left and the right sail portions 8'A and 8'B when the left and the right sail portions 8'A and 8'B are pivoted to the folded position. The left and the right sail portions 8'A and 8'B are symmetrically pivoted around the pivot shaft 7' relative to the mast 1' by a drive mechanism 9' similar to that for the rigid marine sail of the above-mentioned prior art 1. More particularly, the left and the right sail portions 8'A and 8'B are symmetrically pivoted between the deployed position and the folded position around the pivot shaft 7 relative to the mast 1' by moving up and down a movable rod 11 secured to the mast 1' through a plurality of guide members 10 in parallel with the mast 1'. In FIG. 7, 13 are plural pairs of connecting rods connecting the left and the right sail portions 8'A and 8'B with the movable rod 11 through swivel bearings 14A and 14B fitted to the both ends of the connecting rods 13.

The rigid marine sail of the prior art 2 described above also involves a problem similar to that in the rigid marine sail of the above-mentioned prior art 1.

There is therefore a demand for a rigid marine sail in which, when the left sail portion 8'A and the right sail portion 8'B are pivoted to the folded position thereof, a vertical force F' does not act on the left and the right sail portions 8'A and 8'B, and in which it is possible to secure the left and the right sail portions 8'A and 8'B to a mast 1' so that the front end area is minimized when the left and the right sail portions 8'A and 8'B are pivoted to the folded position, but such a rigid marine sail is not as yet proposed.

SUMMARY OF THE INVENTION

An object of the present invention is therefore to provide a rigid marine sail in which, when a left sail portion and a right sail portion are pivoted to the folded position thereof, a vertical force does not act on the left and the right sail portions, and in which it is possible to secure the left and the right sail portions to a mast so that the front end area is minimized when the left and the right sail portions are pivoted to the folded position.

In accordance with one of the features of the present invention, there is provided a rigid marine sail which comprises:

a vertical mast secured onto the deck of a ship, said mast being rotatable around the vertical axis thereof; at least one pivot shaft provided substantially in parallel with said mast; a left sail portion and a right sail portion pivotally secured respectively to the left side and the right side of said mast substantially in parallel therewith through said at least one pivot shaft; and at least one drive mechanism for symmetrically pivoting said left sail portion and said right sail portion relative to said mast around said at least one pivot shaft between a deployed position and a folded position;

characterized by:

each of said at least one drive mechanism (9) comprising:

a set of a cylinder (20) and a piston rod (21) secured substantially horizontally to said mast (1);

a pair of L-shaped first levers (22), each of said pair of first levers (22) horizontally engaging at an end thereof with an end of said piston rod (21) through an elliptic through-hole (22A) of each of said pair of first levers (22), said pair of first levers (22) being bilaterally arranged symmetrically relative to a vertical plane which passes through said vertical axis of said mast (1) and is parallel to the longitudinal direction of said ship, said pair of first levers (22) being symmetrically pivotable relative to said vertical plane around respective fulcrums (24) thereof;

a pair of second levers (26), each of said pair of second levers (26) horizontally engaging at an end thereof with the other end of each of said pair of first levers (22), said pair of second levers (26) being bilaterally arranged symmetrically relative to said vertical plane, said pair of second levers (26) engaging at the other ends thereof respectively with said left sail portion (8A) and said right sail portion (8B);

whereby said left and said right sail portions (8A, 8B) are pivotable to said deployed position through said pair of first levers (22) and said pair of second levers (26) by actuating said set of the cylinder (20) and the piston rod (21) to retract said piston rod (21), and said left and said right sail portions (8A, 8B) are pivotable to said folded position through said pair of first levers (22) and said pair of second levers (26) by actuating said set of the cylinder (20) and the piston rod (21) to extend said piston rod (21).

DETAILED DESCRIPTION OF PREFERRED EMBODIMENTS

Figure 1:
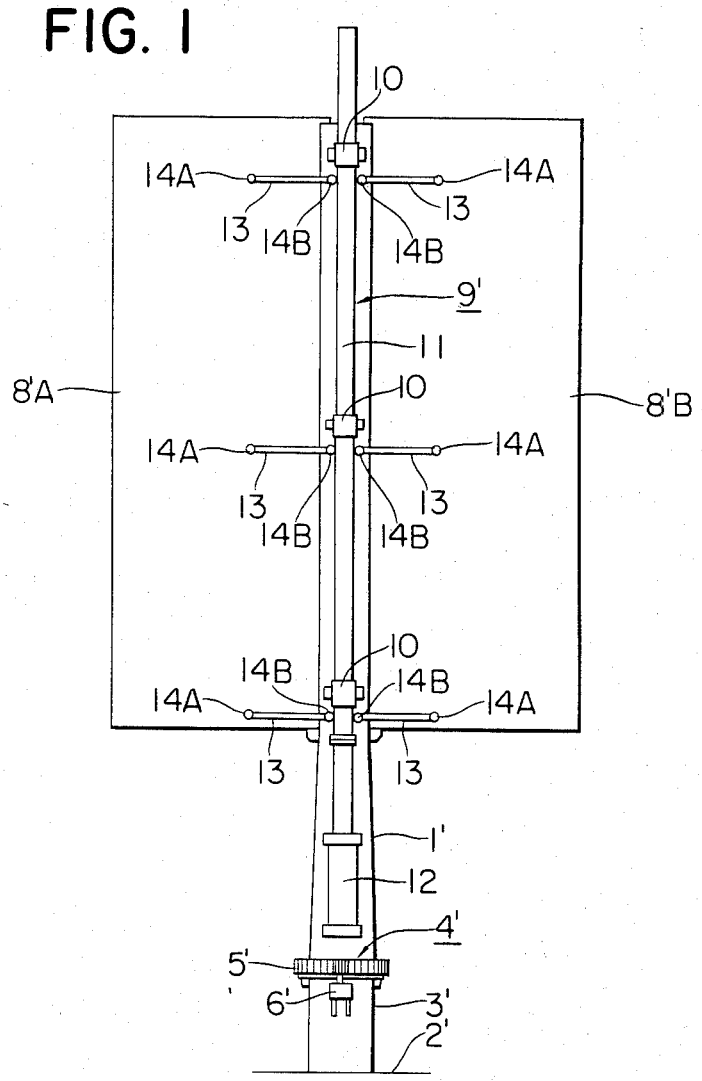
PRIOR ART FIG. 1
FIG. 1 is a front view illustrating a conventional rigid marine sail in the deployed position.
Figure 2:
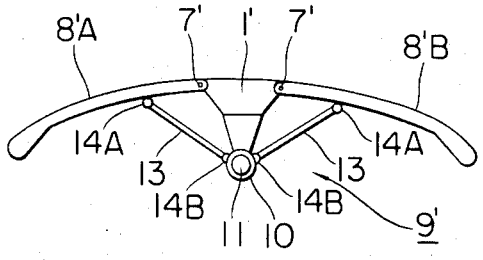
PRIOR ART FIG. 2
FIG. 2 is a plan view illustrating the conventional rigid marine sail shown in FIG. 1 in the deployed position.
Figure 3:
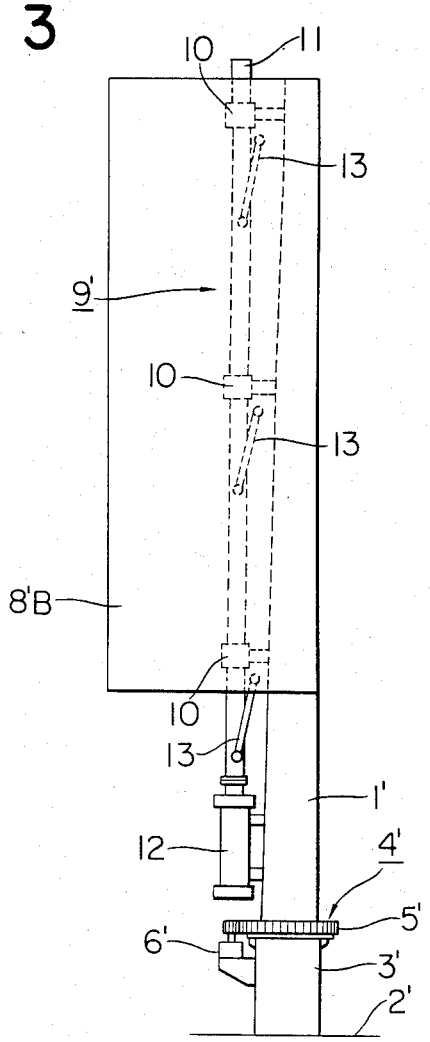
PRIOR ART FIG. 3
FIG. 3 is a right side view illustrating the conventional rigid marine sail shown in FIG. 1 in the folded position.
Figure 4:
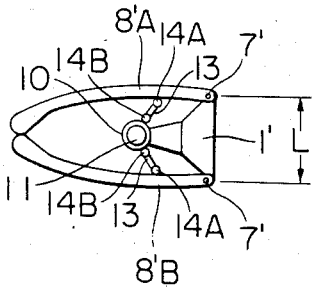
PRIOR ART FIG. 4
FIG. 4 is a plan view illustrating the conventional rigid marine sail shown in FIG. 1 in the folded position.
Figure 5:
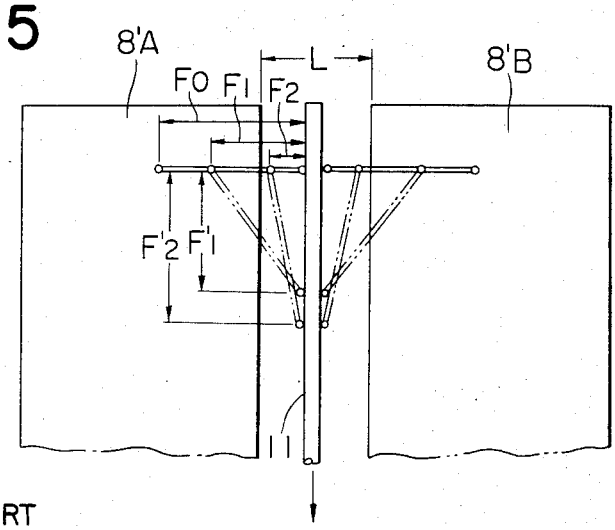
PRIOR ART FIG. 5
FIG. 5 is a schematic descriptive view illustrating a moving state of connecting rods of the conventional rigid marine sail shown in FIG. 1.
Figure 6:
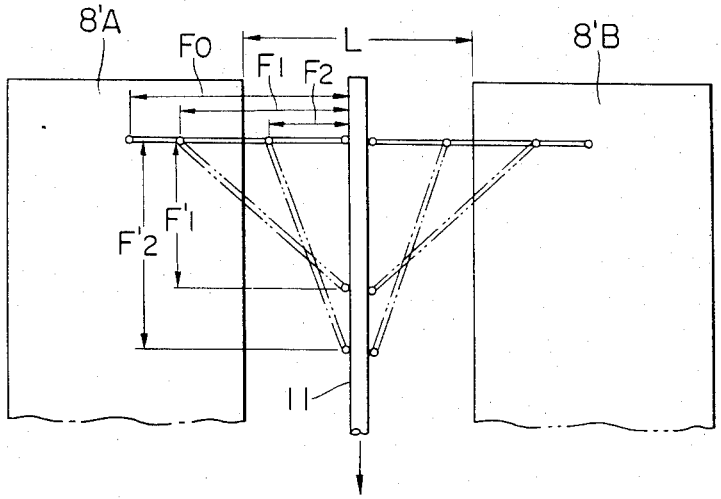
PRIOR ART FIG. 6
FIG. 6 is a schematic descriptive view illustrating another moving state of connecting rods of the conventional rigid marine sail shown in FIG. 1.

With a view to solving the above-mentioned problems, we carried out extensive studies. As a result, we obtained a finding that the above-mentioned problems can be solved by pivoting the left sail portion and the right sail portion by only the horizontal force perpendicular to the pivot shafts of these sail portions. The present invention was made on the basis of this finding.

An embodiment of the rigid marine sail of the present invention is described below with reference to the drawings. In FIGS. 8 to 11, 1 is a mast vertically secured onto a deck 2 of a ship in such a manner that the lower end portion of the mast 1 is inserted into a mast support 3 fixed onto the deck 2, the front face of the mast 1 forming part of the sail face; 4 is a mast rotation mechanism for rotating the mast 1 around the vertical axis thereof, the mast rotation mechanism 4 comprising a gear 5 horizontally fixed to the lower end portion of the mast 1 and a motor 6 secured onto a side of the mast support 3 for rotating the gear 5; 7 are two pivot shafts one each provided on the left side and on the right side of the mast 1 substantially in parallel with the mast 1; 8A is a left sail portion, 8B is a right sail portion, the left and the right sail portions 8A and 8B being pivotally secured respectively to the left and the right sides of the mast 1 substantially in parallel therewith through the respective pivot shafts 7; and, 9 are a plurality of drive mechanisms for symmetrically pivoting the left and the right sail portions 8A and 8B relative to the mast 1 around the respective pivot shafts 7 between the deployed position and the folded position.

Figure 12:
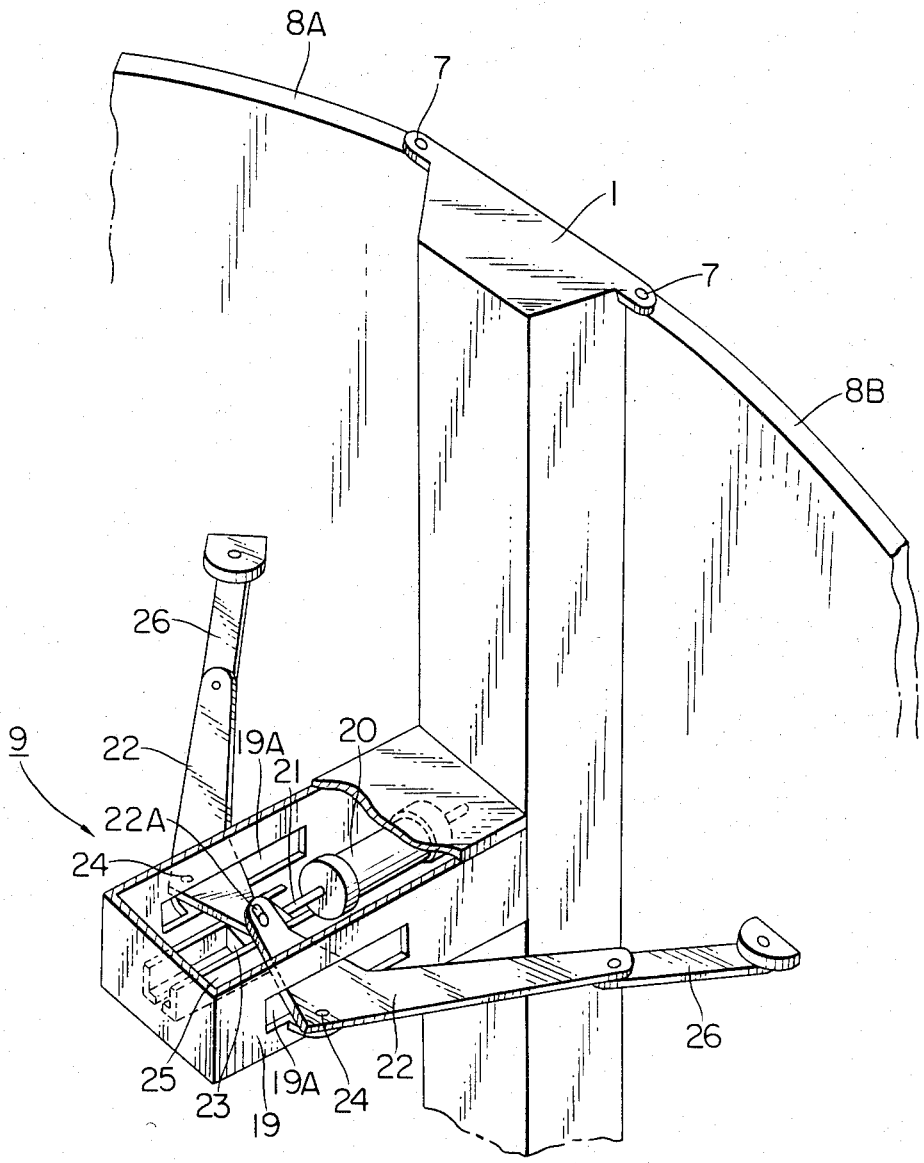
FIG. 12 is a partially cutaway perspective view illustrating an embodiment of the drive mechanism of the rigid marine sail of the present invention shown in FIG. 8.

Now, each of the plurality of drive mechanisms 9 of the present invention is described in detail with reference to FIG. 12. In FIG. 12, 19 is a casing horizontally fixed to the back face of the mast 1, openings 19A for passing a pair of first levers described later being formed on the left and the right sides of the casing 19; 20 is a cylinder, actuated for example by a hydraulic medium, secured to the back face of the mast 1; 21 is a piston rod for the cylinder 20, this set of the cylinder 20 and the piston rod 21 being housed in the casing 19; 22 are a pair of L-shaped first levers, each of the pair of first levers 22 horizontally engaging at an end thereof through its elliptic through-hole 22A with an end of the piston rod 21 via a fitting 23, the pair of first levers 22 being bilaterally arranged symmetrically relative to a vertical plane which passes throuth the vertical axis of the mast 1 and is parallel to the longitudinal direction of the ship, and the pair of first levers 22 being symmetrically pivotable relative to the above-mentioned vertical plane around respective fulcrums 24; 25 is a guide rail fixed onto the inner face of the casing 19 and extending perpendicularly to the mast 1, the guide rail 25 guiding the fitting 23; and 26 are a pair of second levers, each of the pair of second levers 26 horizontally engaging at end thereof with the other end of each of the pair of first levers 22, the pair of second levers 26 being bilaterally arranged symmetrically relative to the vertical plane mentioned above, and the pair of second levers 26 engaging at the other ends thereof respectively with the left sail portion 8A and the right sail portion 8B. The plurality of drive mechanisms 9 each having the above-mentioned structure are arranged on the back face of the mast 1 at prescribed intervals in the vertical direction.

Now, the operation of the above-mentioned embodiment of the rigid marine sail of the present invention is described below. To pivot the left sail portion 8A and the right sail portion 8B from the deployed position shown in FIGS. 8 and 9 to the folded position shown in FIGS. 10 and 11, the set of the cylinder 20 and the piston rod 21 of each of the plurality of drive mechanisms 9 is actuated (i.e. by pressure fluid or the like) to extend the piston rod 21, whereby the pair of first levers 22 are symmetrically pivoted relative to the abovementioned vertical plane around the respective fulcrums 24 so that the pair of first levers 22 come near to each other. As a result, the left sail portion 8A and the right sail portion 8B are symmetrically pivoted relative to the above-mentioned vertical plane around the respective pivot shafts 7 to the folded position through the pair of second levers 26. To pivot the left sail portion 8A and the right sail portion 8B from the folded position to the deployed position, on the other hand, the set of the cylinder 20 and the piston rod 21 of each of the plurality of drive mechanisms 9 is actuated (i.e., by pressure fluid or the like) to retract the piston rod 21, whereby the pair of first levers 22 are symmetrically pivoted relative to the above-mentioned vertical plane around the respective fulcrums 24 so that the pair of first levers 22 go away from each other. As a result, the left sail portion 8A and the right sail portion 8B are symmetrically pivoted relative to the above-mentioned vertical plane around the respective pivot shafts 7 to the deployed position through the pair of second levers 26.

Results of our experiment demonstrate that, when pivoting the left and the right sail portions 8A and 8B to the deployed position with the use of the plurality of drive mechanisms 9 of the present invention, it is possible to reduce the ratio of the distance between the pivot shafts 7 to the overall sail width to below about 15%.

The above description covers the embodiment of the present invention in which the two pivot shafts 7 are provided one each on the left side and the right side of the mast 1, and the left sail portion 8A and the right sail portion 8B are pivotally secured respectively to the left side and the right side of the mast 1 through the respective pivot shafts 7, and the plurality of drive mechanisms 9 of the present invention are arranged on the back face of the mast 1 at prescribed intervals in the vertical direction.

Figure 7:
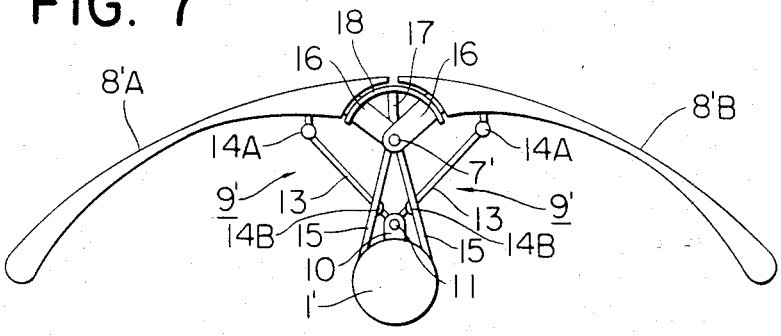
PRIOR ART FIG. 7
FIG. 7 is a plan view illustrating another conventional rigid marine sail in the deployed position.
Figure 13:
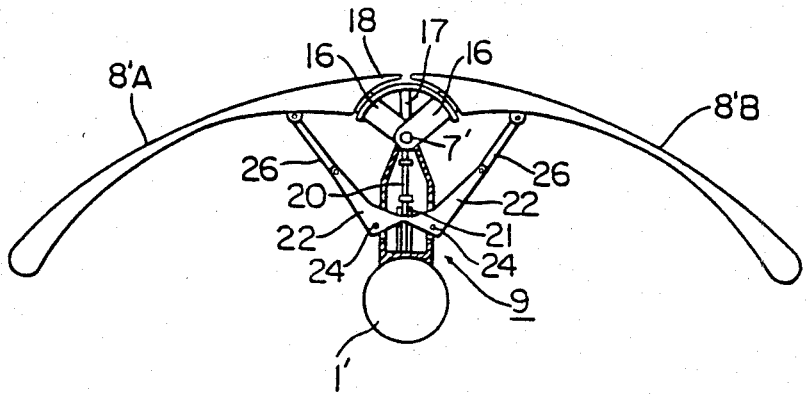
FIG. 13 is a plan view of another embodiment of the invention in the deployed position.

However, the plurality of drive mechanisms 9 are also applicable to the conventional rigid marine sail shown in FIG. 7. More specifically, in this another embodiment of the present invention, which is illustrated in FIG. 13, the one pivot shaft 7′ is provided at a position between the mast 1′ and the left and the right sail portions 8′A and 8′B, the left and the right sail portions 8′A and 8′B pivotally engage at respective ends thereof with the pivot shaft 7′, and, instead of the conventional drive mechanism 9′ having the structure mentioned above, the plurality of drive mechanisms 9 of the present invention are arranged on the front face of the mast 1′ at prescribed intervals in the vertical direction.

Now, the operation of the FIG. 13 embodiment of the rigid marine sail is described below. In order to pivot the left sail portion 8′A and the right sail portion 8′B from the deployed position to the folded position, or from the folded position to the deployed position, the set of the cylinder 20 and the piston rod 21 of each of the plurality of drive mechanisms 9 is actuated, in the same manner as the above-discussed embodiment of the rigid marine sail of the present invention, to extend or retract the piston rod 21, whereby the pair of first levers 22 are symmetrically pivoted relative to the vertical plane which passes through the vertical axis of the mast 1′ and which is parallel to the longitudinal direction of the ship, around the respective fulcrums 24 so that the pair of first levers 22 come near to each other or go away from each other. As a result, the left sail portion 8′A and the right sail portion 8′B are symmetrically pivoted relative to the above-mentioned vertical plane around the one pivot shaft 7′ from the deployed position to the folded position, or from the folded position to the deployed position, through the pair of second levers 26.

Figure 8:
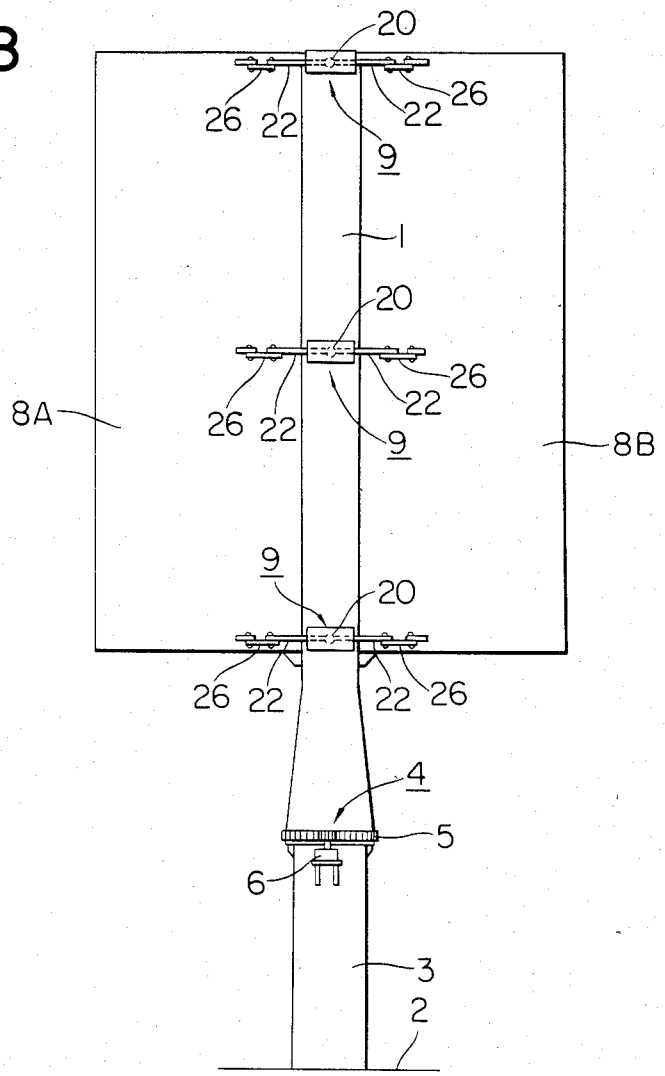
FIG. 8 is a front view illustrating an embodiment of the rigid marine sail of the present invention in the deployed position.
Figure 9:
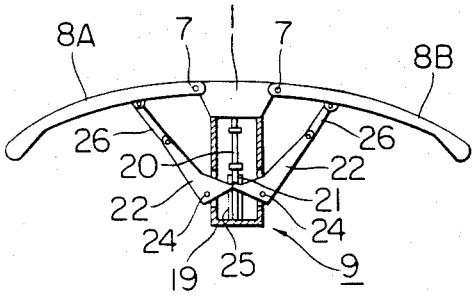
FIG. 9 is a partially cutaway plan view illustrating the rigid marine sail of the present invention shown in FIG. 8 in the deployed position.
Figure 10:
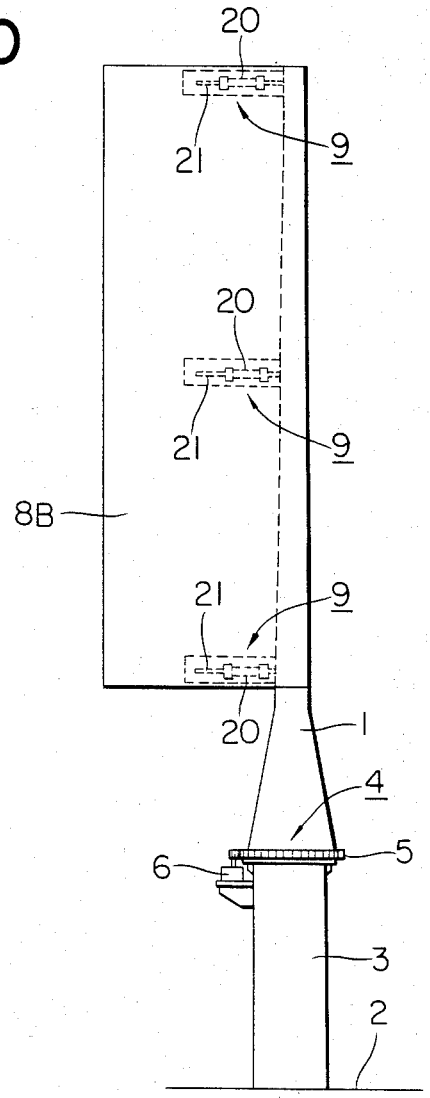
FIG. 10 is a right side view illustrating the rigid marine sail of the present invention shown in FIG. 8 in the folded position.
Figure 11:
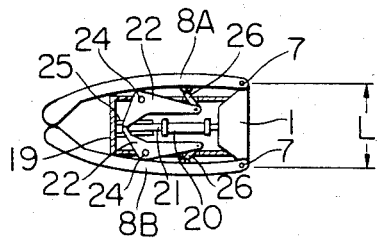
FIG. 11 is a partially cutaway plan view illustrating the rigid marine sail of the present invention shown in FIG. 8 in the folded position.

Three drive mechanisms 9 are arranged to the mast 1 at prescribed intervals in the axial direction of the mast 1 in the embodiment shown in FIG. 8. It is however needless to mention that the number of the drive mechanisms 9 is not limited to three, but appropriately selected depending upon the size of the left and the right sail portions.

By installing at least one connecting mechanism, which has the same construction as the above-mentioned drive mechanism 9 except that the set of the cylinder 20 and the piston rod 21 is eliminated from the latter, at a position between the mast 1 and the left and the right sail portions 8A and 8B, it is possible to increase the securing strength of the left and the right sail portions 8A and 8B to the mast 1 in the case where the left and the right sail portions 8A and 8B in the deployed position receive a fair wind.

According to the present invention, as described above in detail, it is possible to pivot the left sail portion 8A and the right sail portion 8B by only the horizontal force perpendicular to the pivot shafts 7, so that an adverse force does not act on the left and the right sail portions 8A and 8B even when pivoting the left and the right sail portions 8A and 8B to the folded position, unlike the rigid marine sails of the prior art 1 and the prior art 2 mentioned above. It is therefore possible to secure the left and the right sail portions 8A and 8B to the mast 1 with the minimum distance between the pivot shafts 7, thus permitting minimization of the front end area when pivoting the left and the right sail portions 8A and 8B to the folded position. As a result, air resistance suffered from by the front end area can be minimized, and particularly allows stable navigation when the ship runs against a head wind, thus providing useful effect.

What is claimed is:

1. In a rigid marine sail which comprises:

a vertical mast secured onto the deck of a ship, said mast being rotatable around the vertical axis thereof; at least one pivot shaft provided substantially in parallel with said mast; a left sail portion and a right sail portion pivotally mounted substantially in parallel with said mast through said at least one pivot shaft, said left and right sail portions being arranged respectively on left and right sides of said mast; and at least one drive mechanism coupled to said sail portions and to said mast for symmetrically pivoting said left sail portion and said right sail portion relative to said mast around said at least one pivot shaft between a deployed position of said sail portions and a folded position of said sail portions;

the improvement wherein:

each of said at least one drive mechanism (9) comprises:

a set of a cylinder (20) and a piston rod (21) secured substantially horizontally to said mast (1);

a pair of L-shaped first levers (22), each of said pair of first levers (22) having two ends and having a respective substantially elliptical through-hole (22A) at an end thereof for horizontally engaging with an end of said piston rod (21) through said substantially elliptical through-hole (22A), said pair of first levers (22) being bilaterally arranged symmetrically relative to a vertical plane which passes through said vertical axis of said mast (1) and is parallel to the longitudinal direction of said ship, and means for pivotally mounting said pair of first levers (22) for symmetrical pivotable movement thereof relative to said vertical plane around respective fulcrums (24) thereof;

a pair of second levers (26), each of said pair of second levers (26) having two ends having engaging means at respective ends thereof for horizontally engaging at said ends thereof with the other end of a respective one of said pair of first levers (22), said pair of second levers (26) being bilaterally arranged symmetrically relative to said vertical plane, said pair of second levers (26) including means at the other ends thereof for engaging respectively with said left sail portion (8A) and said right sail portion (8B); and actuataing means for selectively actuating said set of the cylinder (20) and the piston rod (21) to retract said piston rod (21) to cause said left and said right sail portions (8A, 8B) to pivot about their respective pivotal mountings to said deployed position through said pair of first levers (22) and said pair of second levers (26), and for selectively actuating said set of the cylinder (20) and the piston rod (21) to extend said piston rod (21) to cause said left and said right sail portions (8A, 8B) to pivot about their respective pivotal mountings to said folded position through said pair of first levers (22) and said pair of second levers (26).

2. The rigid marine sail as claimed in claim 1, wherein:

two of said pivot shafts are provided, one each on the left side and on the right side of said mast (1); and said at least one drive mechanism (9) is mounted onto the back face of said mast and extends rearwardly of said mast.

3. The rigid marine sail as claimed in claim 1, wherein:

said at least one pivot shaft comprises a single pivot shaft (7') provided at a position between said mast (1') and said left and said right sail portions; and said at least one drive mechanism (9) is mounted onto the front face of said mast and extends forwardly of said mast.

4. The rigid marine sail as claimed in claim 1, comprising a plurality of said drive mechanisms distributed along the axial direction of said mast, said drive mechanisms being spaced from each other and mounted to said mast.

5. The rigid marine sail as claimed in claim 2, comprising a plurality of said drive mechanisms distributed along the axial direction of said mast, said drive mechanisms being spaced from each other and mounted to said mast.

6. The rigid marine said as claimed in claim 3, comprising a plurality of said drive mechanisms distributed along the axial direction of said mast, said drive mechanisms being spaced from each other and mounted to said mast.

* * * * *